United States Patent [19]

Culling

[11] Patent Number: 4,917,860

[45] Date of Patent: Apr. 17, 1990

[54] CORROSION RESISTANT ALLOY

[75] Inventor: John H. Culling, St. Louis, Mo.

[73] Assignee: Carondelet Foundry Company, St. Louis, Mo.

[21] Appl. No.: 295,275

[22] Filed: Jan. 10, 1989

[51] Int. Cl.[4] ..... C22C 38/42; C22C 38/44

[52] U.S. Cl. ..... 420/49; 420/35; 420/50; 420/51; 420/61

[58] Field of Search ..... 420/49, 35, 50, 51, 420/58, 61, 586.1

[56] References Cited

U.S. PATENT DOCUMENTS 3,785,787 1/1974 Yokota et al. ..... 420/58

*Primary Examiner*—Deborah Yee

*Attorney, Agent, or Firm*—Senniger, Powers, Leavitt and Roedel

[57] ABSTRACT

Alloys are provided which consist essentially of between about 4% and 18.5% by weight nickel, from about 24% to about 30% by weight chromium, from about 0.35 to about 1% by weight molybdenum, from about 2.7% to about 4.5% by weight copper, from about 2.7% to about 4.5% by weight silicon, up to about 1.5% by weight manganese, up to about 0.25% by weight nitrogen, up to about 0.8% by weight columbium (niobium), up to about 1.0% by weight tantalum, up to about 0.007% by weight boron, up to about 0.35% by weight vanadium, up to about 0.8% by weight tungsten, up to about 0.08% by weight carbon, up to about 0.6% by weight titanium and the balance essentially iron. Small amounts of cobalt as naturally occur in some ores may be present but are considered a part of the nickel content.

12 Claims, No Drawings

CORROSION RESISTANT ALLOY

This invention relates to corrosion resistant alloys, which can be formulated from ferro-alloys, having excellent resistance to very hot concentated sulfuric acid.

BACKGROUND OF THE INVENTION

The handling of very hot concentrated sulfuric acid is a very specialized problem. For example alloys having the very best resistance to hot concentrated sulfuric acid do not perform nearly as well in other corrosive solutions as do other alloys. Conversely the best performing alloys for other applications seldom if ever equal the performance in hot concentrated sulfuric acid of the best alloys designed for the latter purpose.

An iron-base alloy containing 14.5% silicon has been available for many decades for service in hot concentrated sulfuric acid. However, it is non-machinable and at least as brittle as glass. Its great susceptibility to both mechanical and thermal shock severely limits its usefulness. All other alloys to the present time having excellent corrosion resistance to sulfuric acid have been nickel-based or at least of substantial nickel content.

An alloy known as Hastelloy D and consisting of 9% silion and 3% copper in nickel is not as brittle as the silicon-iron alloy but performs well in hot concentrated acid and is, of course, a nickel-based alloy. A variation of Hastelloy D consisting of 9.5% silicon, 2.5% copper and about 3% each of titanium and molybdenum and the balance nickel, has also been developed.

Ordinary austenitic stainless steels of the 18% Cr-8% Ni type can be used in hot sulfuric acid of greater than 98.5% acid strength, but failure is rapid at lower acid concentrations.

All other known alloys developed for service in hot concentrated sulfuric acid have contained large amounts of nickel and chromium with 2.5% to 7% silicon and various amounts of molybdenum and copper. Parr, U.S. Pat. No. 1,115,239, discloses alloys of lower silicon content but they do not possess good resistance to hot concentrated sulfuric acid. However, Parr's alloys were later modified by increasing the silicon content to gain some improvement in performance in hot concentrated sulfuric acid.

Johnson et al, U.S. Pat. No. 2,938,786, and Boyd, et al, U.S. Pat. No. 2,938,787, disclose nickel-based alloys of 22.5% to 28% chromium, 8.5% molybdenum, 5.5% copper, and 2.5% to 7% silicon. These alloys give excellent performance, but are very costly not only because of their high contents of nickel and molybdenum, but also because they require high purity chromium metal for their formulation. Also, they are quite brittle and difficult to machine.

Johnson, U.S. Pat. No. 3,758,296, discloses an alloy of somewhat increased chromium content with reduced nickel content. However, this alloy contains about 6% of the scarce and costly metal cobalt. This alloy is also quite brittle and of very poor machinability.

In my application Ser. No. 234,815 there is disclosed a casting alloy of about 38% Ni, 32% Cr, 4.5% Mo, 3% Cu, 3.6% Si, and 0.55% N. This alloy is less brittle and has better machinability than the alloys of Johnson for hot concentrated sulfuric acid service. It has useful resistance to 85% sulfuric acid to 100° C., to 93% acid to 90° C. and outstanding resistance to 96% to 100% acid solutions to about 110° C.

My application Ser. No. 343,790 discloses an alloy of about 20% Ni, 24% Cr, 0.35% Mo, 3.5% Cu, 3.6% Mn, 2.5% Si, and 0.6% Cb which can be furnished in all wrought forms as well as castings. This alloy has useful resistance to 85% acid to 100° C., to 93% acid to 80° C., to 96% acid to 110° C. and to 98% acid to 200° C. It is a unique alloy in that it has resistance to these acid strengths and yet is capable of being furnished in wrought forms. It is also a low cost alloy. Because of this combination of properties that alloy fills a very important need for manufacturing sulfuric acid resistant pipes, plates, etc, as well as castings.

However, in addition to the corrosion problems associated with handling hot concentrated sulfuric acid, concentrated sulfuric acid streams may contain air bubbles and/or solid particulate matter, both of which tend to cause erosion in cast pump parts and fittings. Thus, there has remained a need for hardenable casting alloys capable of resisting erosion and cavitation while handling very hot concentrated sulfuric acid solutions. There also remains a need for such alloys to be of even lower strategic element content and lower cost than prior alloys.

SUMMARY OF THE INVENTION

According to this invention, alloys are provided which have improved resistance to sulfuric acid over prior alloys at sulfuric acid concentrations above about 80% and to at least 100° C. and to as high as 200° C., even for the most concentrated acid solutions. The instant alloys may also be heat treated to hardnesses as high as 450 Brinell, when they are expected to meet erosion conditions or to be employed in high pressure applications such as bearings.

Among the several objects of the present invention, therefore, may be noted the provision of improved alloys resistant to hot sulfuric acid at concentrations above 80% even when the acid contains contaminants such as gas bubbles and/or solid particulate matter. It is a further object to provide such alloys which are readily castable, machinable and weldable, which may be economically formulated from low-cost copper, silicon and ferro-chromium and which also contain lower amounts of high-cost nickel and molybdenum than prior art alloys specified for similar applications. A further object is to provide alloys which may be easily hardened by a simple heat treatment and the provision of such alloys which may be readily air melted and cast into simple or complex shapes.

The alloys of the invention having these improved properties consist essentially of between about 4% and 18.5% by weight nickel, from about 24% to about 30% by weight chromium, from about 0.35 to about 1% by weight molybdenum, from about 2.7% to about 4.5% by weight copper, from about 2.7% to about 4.5% by weight silicon, up to about 1.5% by weight manganese, up to about 0.25% by weight nitrogen, up to about 0.8% by weight columbium (niobium), up to about 1.0% by weight tantalum, up to about 0.007% by weight boron, up to about 0.35% by weight vanadium, up to about 0.8% by weight tungsten, up to about 0.08% by weight carbon, up to about ;b 0.6% by weight titanium and the balance essentially iron. Small amounts of cobalt as naturally occur in some ores may be present but are considered a part of the nickel content.

DETAILED DESCRIPTION OF THE INVENTION

In accordance with the present invention, alloys are provided which have excellent resistance to hot concentrated pure or contaminated sulfuric acid that is equal or superior to that of prior metallic alloys. The alloys of the invention are, as noted above, air-meltable and air-castable into simple or complex shapes, and are weldable, machinable and hardenable.

Nickel and molybdenum are the two scarcest and most costly elements employed in prior art alloys intended for applications where hot concentrated sulfuric acid is to be contacted. In contrast to such prior art alloys resistant to hot concentrated sulfuric acid which are also weldable and machinable, the alloys of the present invention may contain as little as 4% by weight nickel and up to about 62% by weight iron. Molybdenum contents are also low. Thus the present invention has shown it possible to have excellent resistance to hot concentrated sulfuric acid with nickel and molybdenum contents drastically reduced from the levels of the prior art. Because chromium is chemically a very reactive element, it is considerably more costly to produce chromium metal than it is to produce ferrochromium. Because of the high iron content of the alloys of the present invention the much less costly ferrochromium may be employed in formulating the instant alloys. While used in the present invention in amounts of about 3% or 4% each, copper and silicon are both very low cost, widely available elements.

Small amounts of cobalt, as naturally coexisting in some nickel ore deposits are carried through processing and sometimes appear in alloys of the present invention. They are simply considered as part of the nickel content and may be anywhere from none to about 0.2% by weight in the final alloys of the inventions.

Inasmuch as the alloys of the present invention have a much reduced strategic metal content and therefore lower cost, molybdenum sourcing can be from various scrap return sources as well as the primary source ferromolybdenum. Scrap sources can be, for example, solid molybdenum machine ends and turnings and scrap and worn out high speed tool steel returns. Such sources are often priced on the scrap market at values well below new material costs. Because the present invention may contain small amounts of tungsten and vanadium, the contents of these elements incurred in the use of the high speed tool steel scrap have no adverse effect upon corrorion resistance.

In the absence of carbide stabilizing elements such as vanadium, columbium (niobium) and tantalum, carbon in the melt above about 0.03% by weight will tend to form chromium carbides at the grain boundaries, which cause intergranular attack and impoverishment of matrix chromium levels to some extent. Titanium is also sometimes employed for carbide stabilization. Therefore, when carbon content exceeds about 0.03% by weight, the minimum levels of one or more of these four elements in the alloys of this invention is determined by the following equation in which all percentages are by weight:

$$(C - 0.03\%) = \frac{\%\ V}{5.5} + \frac{\%\ Cb}{10} + \frac{\%\ Ta}{20} + \frac{\%\ Ti}{5}$$

While tantalum is more costly than columbium and only half as effective on a weight basis, sometimes ferroalloys are available in which both elements are present. Generally tantalum would not be present in the alloys of the invention, while even columbium may be omitted when carbon exceeds 0.03% if sufficient vanadium is present. Since it is neither necessary nor desirable for carbon to exceed 0.08% at any time, the maximum allowable vanadium content of about 0.35% would be more than sufficient if no columbium were present, or the maximum of 0.8% columbium would be more than sufficient if no vanadium were present. For purposes of grain refinement and as a margin of error even when melts are calculated not to exceed 0.03% carbon, the presence of small amounts of vanadium and columbium may be regularly added.

While nitrogen is not ordinarily intentionally added to alloys of this invention, small amounts of it are sometimes absorbed during air-melting, and amounts up to about 0.25% by weight have been found not to be detrimental in any way.

Thus, the primary components of the alloys of the invention are:

| | |
|---|---|
| Nickel | 4–18.5% by weight |
| Chromium | 24–30% |
| Molybdenum | 0.3–1% |
| Copper | 2.7–4.5% |
| Silicon | 2.7–4.5% |
| Iron | essentially balance |

Nominally the alloys of the invention will also contain carbon, up to a maximum of about 0.08% by weight and manganese up to about 1.5% by weight. When carbon is present in amounts greater than about 0.03% by weight, it is desirable to include some one or combination of the carbide stabilizers, columbium, tantalum, vanadium or titanium, as discussed above. The limits of these elements set forth below have been found not to be detrimental, while accomplishing the desired effect of carbide stabiliziation.

Boron has been added to many alloys to enhance some types of corrosion resistance as well as some mechanical properties. In the present invention it has been found desirable to limit the boron content to about 0.007% maximum by weight.

Preferred alloys of the present invention are, therefore, those having the following composition:

| | |
|---|---|
| Nickel | 4–10% by weight |
| Chromium | 25–28% |
| Molybdenum | 0.3–0.9% |
| Copper | 3–4% |
| Silicon | 3–4% |
| Manganese | 1% maximum |
| Carbon | 0.08% maximum |
| Nitrogen | 0.25% maximum |
| Vanadium | 0.35% maximum |
| Columbium | 0.8% maximum |
| Tantalum | 1.0% maximum |
| Titanium | 0.6% maximum |
| Tungsten | 0.8% maximum |
| Boron | 0.007% maximum |
| Iron | essentially balance |

For excellent balance between mechanical properties, corrosion resistance and cost it has been found desirable to further restrict the alloys of the invention to the following ranges of proportion:

| | |
|---|---|
| Nickel | 4–10% by weight |

-continued

| | |
|---|---|
| Chromium | 25–28% |
| Molybdenum | 0.3–0.9% |
| Copper | 3–4% |
| Silicon | 3–4% |
| Manganese | 0.3–0.9 |
| Carbon | 0.05% maximum |
| Nitrogen | 0.20% maximum |
| Vanadium | 0.30% maximum |
| Tungsten | 0.50% maximum |
| Columbium | 0.3–0.7% |
| Boron | 0.004% maximum |
| Iron | essentially balance |

A particularly advantageous formulation having optimum chemical, physical, mechanical, and metallurgical properties has the following composition:

| | |
|---|---|
| Nickel | 7.85% by weight |
| Chromium | 27% |
| Molybdenum | 0.45% |
| Copper | 3.5% |
| Silicon | 3.9% |
| Manganese | 0.75% |
| Carbon | 0.025% |
| Nitrogen | 0.20% |
| Vanadium | 0.10% |
| Tungsten | 0.15% |
| Columbium | 0.6% |
| Boron | 0.0035% |
| Iron | essentially balance |

Since it is desirable in alloys of the invention to be able to harden them for service in articles such as bearings or to resist erosion and yet be able to soften then for machining, heat treatments have been sought and found possible for both purposes.

Maximum softness for the alloys of the invention is achieved by a high temperature anneal of two to six hours at about 1950° F. to about 2050° F. followed by a rapid oil quench or, in some instances, even air cooling if the heat treated parts are arranged so that the air blast may cool them quickly. Hardening is achieved by annealing at 1400° F. to about 1600° F. for two to six hours followed by slow cooling, for example, in air or in the furnace as it cools down, or in packed annealing boxes which are pulled out of the furnace at the hardening temperature and allowed to cool in still air.

Hardness levels in the as-cast condition will vary somewhat, depending upon exact analysis, casting weight and configuration, mold material and pouring temperature. Typically the Brinell Hardness Number (BHN) will be about 290 to 320. In the softened condition alloys of the preferred composition will generally be between about 250 and about 290 BHN. In the hardened condition alloys of the preferred composition, that is, alloys of up to about 10% nickel by weight, will have hardnesses between about 375 and 450 BHN.

While nickel contents below about 10% by weight are generally preferred, it has been found that contents as high as 18.5% do not have adverse effect upon corrosion properties. If it is desirable even at a higher cost to obtain alloys of somewhat lower minimum hardnesses, nickel contents in the ranges above 10% along with intentional additions of nitrogen up to a maximum of about 0.25% may be employed. The high temperature heat treatment followed by rapid cooling in oil or forced air blast causes the resultant alloy matrix to be principally nonmagnetic, unstable austenite. Hardnesses thus achieved tend to be about 185 to 260 BHN. The resultant alloys may still be hardened, after forming a desired article, by the lower temperature heat treatment.

The following examples further illustrate the invention.

EXAMPLE 1

One hundred pound heats of several different compositions were prepared in accordance with the invention. Each of the heats was air-melted in a 100-pound high frequency induction furnace. The composition of these heats is set forth in Table I, the balance in each instance being essentially iron. Compositions of comparative alloys are also set forth in Table I, with the balance being essentially iron.

TABLE I

| ALLOY DESIGNATION | PERCENT BY WEIGHT OF ALLOWING ELEMENTS* | | | | | | | | | | | | |
|---|---|---|---|---|---|---|---|---|---|---|---|---|---|
| | NI | CR | MO | CU | SI | MN | N | C | V | CB | W | B | CO |
| 1466 | 8.82 | 25.11 | 0.49 | 3.52 | 3.33 | 0.53 | — | 0.02 | 0.15 | 0.71 | 0.08 | — | — |
| 1467 | 7.43 | 26.08 | 0.44 | 3.48 | 3.83 | 0.58 | — | 0.03 | 0.27 | 0.49 | 0.26 | — | — |
| 1468 | 9.72 | 26.74 | 0.52 | 3.06 | 3.73 | 0.43 | — | 0.05 | — | 0.61 | — | — | — |
| 1469 | 15.41 | 26.31 | 0.81 | 3.22 | 3.13 | 0.57 | — | 0.02 | — | — | — | — | — |
| 1470 | 17.96 | 25.11 | 0.52 | 3.53 | 3.51 | 0.51 | 0.19 | 0.03 | — | 0.22 | — | — | — |
| 1479 | 4.03 | 24.66 | 0.82 | 3.53 | 2.88 | 0.69 | 0.18 | 0.02 | 0.11 | 0.49 | 0.31 | .0031 | — |
| 1485 | 7.85 | 27.18 | 0.42 | 3.41 | 3.93 | 0.75 | 0.19 | 0.00 | 0.11 | 0.60 | 0.14 | .0035 | — |
| Illium 98 | 54.86 | 28.11 | 8.48 | 5.51 | 0.68 | 1.23 | — | 0.05 | — | — | — | — | — |
| Illium B | 49.84 | 27.98 | 8.51 | 5.49 | 3.52 | 1.19 | — | 0.05 | — | — | — | 0.50 | — |
| 3,758,296 | 33.56 | 32.04 | 4.71 | 2.88 | 3.66 | 2.85 | — | 0.08 | — | — | — | 0.05 | 6.02 |

*Balance essentially iron

Standard physical test blocks and corrosion test bars were cast from each heat. Brinell hardness values in the as cast condition, the softened condition (oil quenched) and in the hardened condition (furnace cooled) were determined for the alloys of the invention. These values are set forth in Table II.

TABLE II

| ALLOY NUMBER | BRINELL HARDNESS NUMBERS | | |
|---|---|---|---|
| | AS CAST | SOFTENED | HARDENED |
| 1466 | 302 | 254 | 410 |
| 1467 | 310 | 276 | 454 |
| 1468 | 310 | 265 | 440 |
| 1469 | 305 | 263 | 395 |
| 1470 | 305 | 188 | 375 |
| 1479 | 302 | 269 | 380 |
| 1485 | 321 | 286 | 444 |

Ranges of tensile values for alloys of the invention in various heat treated conditions are sent forth in Table III.

TABLE III

| | TENSILE STRENGTH PSI | ELASTIC LIMIT PSI | ELONGATION % IN 2 INCHES |
|---|---|---|---|
| As Cast | 50-78,000 | 50-70,000 | 0.5-4.0 |
| Softened | 53-60,000 | 53-58,000 | 1.0-3.5 |
| Hardened | 50-86,000 | 50-82,000 | 0-1.0 |

EXAMPLE 2

The cast corrosion test bars were machined into 1½ inch diameter by ¼ inch thick discs, each having a ⅛ inch diameter hole in the center. These discs were carefully machined to size and polished to a 600-grit finish. Each disc was weighed to the nearest 10,000th of a gram and then suspended in a flask by a platinum wire hooked through the center hole of the disc and attached to the top of the flask. Sufficient 98% sulfuric acid was then added to the flask so that the disc was completely immersed in the acid and a fitted water cooled (condesing) top was installed. The temperature of the acid was maintained at various temperatures from 80° C. to 210° C. by means of a hot plate.

The corrosion tests were conducted for 24 hours, after which period the discs were removed from the sulfuric acid and cleaned of the corrosion products by brushing with a nylon brush and tap water. After the corrosion products had been removed, each disc was dried and weighed again to the nearest 10,000th of a gram.

The corrosion rate for each disc, in mils (one mil=0.001 inch) per year, was calculated in accordance with the formula $$R_{mpy} = 393.7 \frac{W_o - W_f}{ATD}$$

where $R_{mpy}$=corrosion rate in mils per year $W_o$=original weight of sample in grams $W_f$=final weight of sample in grams A=area of sample in square cm.

T=duration of the test in years

D=density of alloy in gm./cc.

The results of these tests on a typical alloy of the invention, 1485, are set forth in Table IV along with those of commercial alloys.

In the corrosion data the units employed to measure corrosion depth were mils. The rate of attack is expressed in mils per year (M.P.Y.).

TABLE IV

CORROSION RATE IN MILS OF PENETRATION PER YEAR IN 98% SULFURIC ACID AT VARIOUS TEMPERATURES

| | ALLOY | | |
|---|---|---|---|
| TEMPERATURE °C. | 1485 | ILLIUM B | ILLIUM 98 |
| 80 | 0.9 | 0.9 | 2.1 |
| 90 | 2.3 | 2.2 | 4.9 |
| 100 | 5.1 | 4.7 | 10.7 |
| 110 | 10.7 | 10.5 | 31.0 |
| 120 | 16.0 | 23.6 | 59.5 |
| 130 | 18.7 | 34.3 | 67.2 |
| 140 | 18.9 | 87 | 147.1 |
| 150 | 16.4 | 157 | 235 |
| 160 | 13.4 | 245 | 398 |
| 170 | 11.3 | 404 | 622 |
| 180 | 10.2 | 615 | 870 |
| 190 | 10.8 | 833 | N.T. |
| 200 | 11.4 | 1223 | N.T. |

TABLE IV-continued

CORROSION RATE IN MILS OF PENETRATION PER YEAR IN 98% SULFURIC ACID AT VARIOUS TEMPERATURES

| | ALLOY | | |
|---|---|---|---|
| TEMPERATURE °C. | 1485 | ILLIUM B | ILLIUM 98 |
| 210 | 14.2 | 1622 | N.T. |

N.T. = Not tested

In some applications 20 MPY or even 30 MPY corrosion rate may be tolerated, but a 10 MPY maximum rate of attack is more realistic for many valve and pump parts. From the above it is evident that the alloys of the invention can meet any corrosive situation for which the Illium alloys are suitable as well as the temperature ranges above about 130° C. for which the Illium alloys are quite unsuited.

Alloys of the present invention were also tested at 100° C. for 24 hours in acid strengths of 80%, 85%, 90%, 93%, 96% and 98%. The results of such tests as well as tests of prior art alloys are set forth in Table V.

TABLE V

CORROSION RATE IN MILS OF PENETRATION PER YEAR IN VARIOUS SULFURIC ACID STRENGTHS AT 100° C.

| ALLOY DESIGNATION | 80% | 85% | 90% | 93% | 96% | 98% |
|---|---|---|---|---|---|---|
| 1466 | 23.7 | 10.1 | 10.3 | 9.7 | 5.8 | 4.3 |
| 1467 | 11.2 | 5.9 | 4.5 | 3.4 | 2.7 | 2.3 |
| 1468 | 13.1 | 8.1 | 7.3 | 4.3 | 3.0 | 2.8 |
| 1469 | 29.3 | 16.8 | 17.3 | 13.2 | 6.7 | 3.7 |
| 1470 | 16.8 | 10.6 | 11.2 | 6.7 | 3.9 | 3.1 |
| 1479 | 41.3 | 17.7 | 18.8 | 18.3 | 7.7 | 5.3 |
| 1485 | 10.2 | 5.0 | 3.6 | 3.1 | 2.5 | 5.1 |
| Illium 98 | 29.1 | 22.8 | 19.6 | 18.1 | 16.3 | 15.8 |
| Illium B (3.5% Si) | 24.4 | 21.1 | 14.9 | 10.2 | 5.1 | 4.5 |

From these results it may be seen that alloys of the invention can be employed in all acid strengths over 80% at temperatures to at least 100° C. with a minimum amount of corrosion.

In view of the above, it will be seen that the several objects of the invention are achieved and other advantageous results attained.

As various changes could be made in the above alloys without departing from the scope of the invention, it is intended that all matter contained in the above description shall be interpreted as illustrative and not in a limiting sense.

I claim:

1. An alloy which is hardenable and castable and has good corrosion resistance to hot concentrated sulfuric acid consisting essentially of:

| | |
|---|---|
| Nickel | 4-18.5% by weight |
| Chromium | 24-30% |
| Molybdenum | 0.3-1% |
| Copper | 2.7-4.5% |
| Silicon | 2.7-4.5% |
| Manganese | up to about 1.5% |
| Nitrogen | up to about 0.25% |
| Carbon | up to about 0.08% |
| Vanadium | up to about 0.35% |
| Columbium | up to about 0.8% |
| Tantalum | up to about 1.0% |
| Titanium | up to about 0.6% |
| Tungsten | up to about 0.8% |
| Boron | up to about 0.007% |
| Iron | essentially balance |

provided, however, that when carbon exceeds about 0.03%, the minimum proportion of one or more of vanadium, columbium, tantalum and titanium contained in said alloy, up to the percentages set forth above, is determined according to the equation:

$$\% C - 0.03\% = \frac{\% V}{5.5} + \frac{\% Cb}{10} + \frac{\% Ta}{20} + \frac{\% Ti}{5}$$

2. An alloy of claim 1 where carbon exceeds about 0.03% and tantalum and titanium are essentially absent.

3. An alloy of claim 1 containing:

| | |
|---|---|
| Nickel | 4–10% by weight |
| Chromium | 25–28% |
| Molybdenum | 0.3–0.9% |
| Copper | 3–4% |
| Silicon | 3–4% |
| Manganese | 1% maximum |

4. An alloy of claim 2 containing:

| | |
|---|---|
| Nickel | 4–10% by weight |
| Chromium | 25–28% |
| Molybdenum | 0.3–0.9% |
| Copper | 3–4% |
| Silicon | 3–4% |
| Manganese | 0.3–0.9% |
| Nitrogen | 0.20% maximum |
| Carbon | 0.05% maximum |
| Vanadium | 0.30% maximum |
| Columbium | 0.3–0.7% |
| Tungsten | 0.50% maximum |
| Boron | 0.004% maximum |
| Iron | essentially balance |

5. An alloy of claim 4 containing

| | |
|---|---|
| Nickel | 7.85% by weight |
| Chromium | 27% |
| Molybdenum | 0.45% |
| Copper | 3.5% |
| Silicon | 3.9% |
| Manganese | 0.75% |
| Nitrogen | 0.20% |
| Carbon | 0.025% |
| Vanadium | 0.10% |
| Columbium | 0.6% |
| Tungsten | 0.15% |
| Boron | 0.0035% |
| Iron | essentially balance |

6. An alloy of claim 2 containing

| | |
|---|---|
| Nickel | 8.82% by weight |
| Chromium | 25.11% |
| Molybdenum | 0.49% |
| Copper | 3.52% |
| Silicon | 3.33% |
| Manganese | 0.53% |
| Carbon | 0.02% |
| Vanadium | 0.15% |
| Columbium | 0.71% |
| Tungsten | 0.08% |
| Iron | essentially balance |

7. An alloy of claim 4 containing

| | |
|---|---|
| Nickel | 7.43% by weight |
| Chromium | 26.08% |
| Molybdenum | 0.44% |
| Copper | 3.48% |
| Silicon | 3.83% |
| Manganese | 0.58% |

-continued

| | |
|---|---|
| Carbon | 0.03% |
| Vanadium | 0.27% |
| Columbium | 0.49% |
| Tungsten | 0.26% |
| Iron | essentially balance |

8. An alloy of claim 4 containing

| | |
|---|---|
| Nickel | 9.72% by weight |
| Chromium | 26.74% |
| Molybdenum | 0.52% |
| Copper | 3.06% |
| Silicon | 3.73% |
| Manganese | 0.43% |
| Carbon | 0.05% |
| Columbium | 0.61% |
| Iron | essentially balance |

9. An alloy of claim 2 containing

| | |
|---|---|
| Nickel | 15.41% by weight |
| Chromium | 26.31% |
| Molybdenum | 0.81% |
| Copper | 3.22% |
| Silicon | 3.13% |
| Manganese | 0.57% |
| Carbon | 0.02% |
| Iron | essentially balance |

10. An alloy of claim 2 containing

| | |
|---|---|
| Nickel | 17.96% by weight |
| Chromium | 25.11% |
| Molybdenum | 0.52% |
| Copper | 3.53% |
| Silicon | 3.51% |
| Manganese | 0.51% |
| Nitrogen | 0.19% |
| Carbon | 0.03% |
| Columbium | 0.22% |
| Iron | essentially balance |

11. An alloy of claim 2 containing

| | |
|---|---|
| Nickel | 4.03% by weight |
| Chromium | 24.66% |
| Molybdenum | 0.82% |
| Copper | 3.53% |
| Silicon | 2.88% |
| Manganese | 0.69% |
| Nitrogen | 0.18% |
| Carbon | 0.02% |
| Boron | .0031 |
| Columbium | 0.49% |
| Vanadium | 0.11 |
| Tungsten | 0.31 |
| Iron | essentially balance |

12. An alloy of claim 4 containing

| | |
|---|---|
| Nickel | 7.85% by weight |
| Chromium | 27.18% |
| Molybdenum | 0.42% |
| Copper | 3.41% |
| Silicon | 3.93% |
| Manganese | 0.75% |
| Nitrogen | 0.19% |
| Carbon | 0.00% |
| Boron | .0035% |
| Columbium | 0.60% |
| Vanadium | 0.11 |
| Tungsten | 0.14 |
| Iron | essentially balance |

* * * * *